US012139284B2

(12) United States Patent
Cichy et al.

(10) Patent No.: US 12,139,284 B2
(45) Date of Patent: Nov. 12, 2024

(54) PERISTALTIC PUMP-BASED APPARATUS AND METHOD FOR THE CONTROLLED DISPENSING OF FLUIDS

(71) Applicant: VANRX PHARMASYSTEMS INC., Burnaby (CA)

(72) Inventors: Marcin Czeslaw Cichy, Surrey (CA); Carlos Alberto Diaz Guerrero, Burnaby (CA)

(73) Assignee: VANRX PHARMASYSTEMS INC., Burnaby (CA)

( * ) Notice: Subject to any disclaimer, the term of this patent is extended or adjusted under 35 U.S.C. 154(b) by 3 days.

(21) Appl. No.: 17/849,660

(22) Filed: Jun. 26, 2022

(65) Prior Publication Data

US 2023/0018623 A1 Jan. 19, 2023

Related U.S. Application Data

(62) Division of application No. 17/100,686, filed on Nov. 20, 2020, now Pat. No. 11,370,565, which is a (Continued)

(51) Int. Cl.
*B65B 3/12* (2006.01)
*B65B 3/00* (2006.01)
(Continued)

(52) U.S. Cl.
CPC ..... *B65B 3/12* (2013.01); *B65B 3/003* (2013.01); *F04B 13/00* (2013.01);
(Continued)

(58) Field of Classification Search
CPC . B65B 3/12; B65B 3/003; F04B 13/00; F04B 43/1261; F04B 49/065;
(Continued)

(56) References Cited

U.S. PATENT DOCUMENTS 4,205,948 A * 6/1980 Jones ..... F04B 43/1253 417/477.6
4,218,197 A * 8/1980 Meyer ..... F04B 43/1253 204/402

(Continued)

FOREIGN PATENT DOCUMENTS

| | | |
|---|---|---|
| CN | 201723422 U | 1/2011 |
| CN | 113825911 B | 7/2023 |
| WO | 9601370 A1 | 1/1996 |

OTHER PUBLICATIONS

PCT International Search Report (PCT/CA2020/050749), Date of Issuance: Aug. 24, 2020.

(Continued)

*Primary Examiner* — David Colon-Morales
*Assistant Examiner* — Stephanie A Shrieves
(74) *Attorney, Agent, or Firm* — Brannon Sowers & Cracraft PC; Kevin R. Erdman

(57) ABSTRACT

The present invention involves a rotary peristaltic pump and associated method employing the relaxation of pressure on flexible tubing between the rotor and stator of the pump to restore the rotor to a start angle while a valve on the output of the pump is closed to avoid progress of fluid through the system. Three different implementations of the pump and method are presented including reciprocating the stator, reciprocating the rotor, and retracting the idler rollers of the rotor into the rotor to relieve the pressure on the flexible tubing. A controller ensures the appropriate switching and timing of the valve and rotor of the pump. The pump and associated method are directed to the precision dispensing of pharmaceutical fluids into containers, including containers held in container nests.

16 Claims, 9 Drawing Sheets

Related U.S. Application Data division of application No. 16/430,383, filed on Jun. 3, 2019, now Pat. No. 11,014,697.

(51) Int. Cl.
*F04B 13/00* (2006.01)
*F04B 43/12* (2006.01)
*F04B 49/06* (2006.01)

(52) U.S. Cl.
CPC ..... *F04B 43/1261* (2013.01); *F04B 49/065* (2013.01); *F04B 43/1253* (2013.01); *F04B 43/1276* (2013.01)

(58) Field of Classification Search
CPC ..... F04B 2205/09; F04B 43/1276; F04B 43/1253; F04B 43/1284; F04B 49/106; A61M 5/14228
USPC ..... 141/1
See application file for complete search history.

(56) References Cited

U.S. PATENT DOCUMENTS 4,544,336 A * 10/1985 Faeser ..... A61M 5/142 604/153
4,558,996 A 12/1985 Becker
4,720,249 A * 1/1988 Krebs ..... F04B 43/1253 417/477.8
5,009,573 A * 4/1991 Ring, Sr. ..... F04B 43/1276 417/477.7
5,062,775 A 11/1991 Orth
5,462,417 A * 10/1995 Chapman ..... F04B 43/1276 417/477.7
5,484,239 A 1/1996 Chapman
6,036,459 A 3/2000 Robinson
6,393,338 B1 * 5/2002 Kemnitz ..... F04B 49/065 700/231
6,551,080 B2 * 4/2003 Andersen ..... F04B 43/1284 417/477.7
6,736,617 B2 * 5/2004 Domroese ..... A61M 60/113 417/477.3
6,739,478 B2 5/2004 Bach
9,377,016 B2 6/2016 Bach
9,427,518 B2 8/2016 Brueckner
9,567,993 B2 2/2017 Bach
9,751,748 B2 9/2017 Trebbi
10,036,379 B2 7/2018 Sasa et al.
2002/0064470 A1 5/2002 Anderson
2005/0053502 A1 3/2005 Souza
2005/0180856 A1 * 8/2005 Bach ..... F04B 13/00 417/474
2005/0196307 A1 9/2005 Limoges
2007/0258838 A1 11/2007 Drake
2010/0129247 A1 5/2010 Lauer
2012/0148415 A1 * 6/2012 Brueckner ..... F04B 43/1253 417/1
2015/0013825 A1 * 1/2015 Trebbi ..... F04B 43/1261 141/192
2015/0159642 A1 * 6/2015 Sasa ..... F04B 43/1253 417/279
2015/0300348 A1 10/2015 Bach
2018/0363638 A1 * 12/2018 Holzhausen ..... A61M 5/14232
2018/0370665 A1 12/2018 Broadbent
2019/0047295 A1 * 2/2019 Yokoi ..... B41J 2/16523

OTHER PUBLICATIONS

PCT Written Opinion of the International Searching Authority (PCT/CA2020/050749), Date of Issuance: Aug. 30, 2020.
European Patent Office Extended European Search Report (EP20818477), corresponding to the subject matter of the present application. Date of Mailing; Jun. 19, 2023.
China National Intellectual Property Administration Office Action and Search Report (Chinese Patent Application 202210697143.7), corresponding to the subject matter of the present application. Date of Mailing: Nov. 17, 2023.

* cited by examiner

PERISTALTIC PUMP-BASED APPARATUS AND METHOD FOR THE CONTROLLED DISPENSING OF FLUIDS

CROSS-REFERENCE TO RELATED APPLICATIONS

The present application is a division of U.S. patent application Ser. No. 17/100,686, filed Nov. 20, 2020, now U.S. Pat. No. 11,370,565; which is a division of U.S. patent application Ser. No. 16/430,383, filed on Jun. 3, 2019, now U.S. Pat. No. 11,014,697, the disclosures of which are incorporated by reference in their entireties herein.

BACKGROUND OF THE INVENTION

Field of the Invention

This present invention relates to the medical field and more particularly to those in international patent classification A61J and apparatus and associated methods for sterilization of and sterile handling of pharmaceutical materials and containers for pharmaceuticals, including bringing pharmaceuticals into form for administration to medical or veterinary patients. In one aspect, it relates to the programmed and automatic operation of such apparatus.

Description of the Related Art

The use of controlled filling machines that dispense fluids is well known in the prior art and is becoming widespread in many industries. These machines typically include a product fluid source, a pump to propel the fluid and filling needles for directing the fluid into a container. Peristaltic pumps have a unique advantage over other pumps in that they can be cleaned by merely removing the tubing and replacing it with new tubing. The new tubing may be rapidly loaded, simplifying fluid changeover and making it contamination free. The action of peristaltic pumps is also less damaging to the fluids themselves, which may, for example, contain fragile blood cells. A major problem with peristaltic pumps, however, is precision and accuracy. Over a period of a product dispensing run, the tubing can change, resulting in a loss of precision, because the precision is directly related, among other factors, to the tube diameter and as the rotor speed.

In the pharmaceutical field, the level of tolerance required in filling containers with a pharmaceutical fluid is always very small. It is also known that, in the case of very expensive fluids, or particular or special fluids, even dangerous, toxic, poisonous or polluting ones, it is necessary to confine the filling tolerance to very low values. Depending on the type of fluid introduced, these tolerances may reach factors of 1 to 10 per thousand. With known filling systems, it is not always possible to obtain this required precision and, even when it is obtained, it is not with suitable consistency. This also leads to waste in production because of tolerances not having been met. Such waste not only causes a drop in production and an increase in costs, but also causes problems in reprocessing the containers in order to provide within them the desired quantity of fluid.

A further consideration relates to the dispensing of fluids that are dangerous, toxic, poisonous or polluting. In such cases, the reprocessing of the containers creates problems of cost, safety and contamination both of the product and of the environment. Moreover, there are fluids to be transferred that require continuous protection in order to eliminate possible contaminants, insofar as it is possible. One purpose of the present invention is therefore to perfect a method that allows the prevention of wasted production, at least in relation to expensive or dangerous, toxic, poisonous or polluting fluids, used, for example, for administration to humans, animals or plants.

The present invention relates to a rotary peristaltic pump, and, more particularly, to an apparatus and method for improving the dispensing accuracy of peristaltic pump-based filling machines. Such pumps are generally regarded as delivering a fixed volume for each fixed angular rotation of the driver. In conventional rotary peristaltic pumps the quantity of fluid delivered is generally regarded as being a fixed volume per revolution of the rotor of the pump. Rotary peristaltic pumps are preferred for many filling applications due to their ability to pump fluids through tubing without any contact between pump components and the fluid being pumped. In a typical rotary peristaltic pump system, one or more lengths of tubing are compressed by a series of rollers that rotate to squeeze the tubing against a curved wall of a stator. This provides one or more moving regions of compression along the length of tubing. Movement of the compressed region of the tubing forces fluid ahead of the moving region. In returning to its uncompressed condition, the tubing creates a partial vacuum, which results in forward flow of the fluid from the region behind the compressed region. It has been heretofore assumed that repeating cycles of the same angular rotation of a rotary peristaltic dispenser will deliver consistent quantities of product. However, a problem typically associated with such rotary peristaltic pumps is that it is difficult to obtain accurate and repeatable volume dispensing from them.

A number of approaches in dealing with this problem have been addressed in the prior art. In one approach, accuracy is sought to be enhanced by direct measurement of parameters relating to volume dispensed, motor speed and flow rate. A calculation of a calibration constant may be made to relate known increments of angular rotation of the pump to a known fluid volume. This constant may then be used to determine flow rate and total or cumulative volume dispensed based on counting angular increments of pump rotation. Encoder wheels have also been used in the prior art to improve the accuracy of rotary peristaltic pumps by monitoring the rotation of the drive shaft in small angular sectors. In the prior art examples recited hereinabove, it is assumed that the same angular distance of the driver will cause the delivery of the same volume of the product once the pump has been calibrated. When the simple calibration factor described here is utilized, a relatively large absolute error in the quantity of dispensed product results. This error is larger when peristaltic tubes of a larger inner diameter are used to achieve high production speeds. The error is even more significant when filling small volumes. The weakness of these models results from the assumption that the relation between the angle of rotation of the pump rotor and the dispensed volume of the product is a linear function with a constant coefficient linking the volume and angular distance of the driver of the rotor.

In the prior art, various approaches have been used to ensure that two consecutive dispensing cycles of a peristaltic pump would produce identical amounts of dispensed fluid. Generally, these methods function under the assumption that rotating the rotor of the pump through a selected angular displacement will produce the same volume of dispensed fluid independent of the initial angle of the rotor. However, the vagaries of the flexible tubing employed in peristaltic pumps almost inherently ensure that the volume of liquid dispensed between zero degrees rotor angle and 55 degrees will not be the same as the volume of fluid dispensed when the rotor subsequently rotates from 55 degrees to 110 degrees. There are, however, examples in the prior art in which inventors have realized this fact, and have sought to re-zero the pump to the same starting angle for every dispensing cycle. The challenge in such a case is that of having to return pumped fluid to the fluid source via some manner of valved bypass fluid circuit while the pump advances to the same starting angle as employed in a previous dispensing cycle. One of the drawbacks of such an arrangement, as that the flexible tube is worn out performing no useful dispensing while the undue wear ensures that control over the dispensing is compromised.

SUMMARY OF THE INVENTION

In a first aspect a peristaltic pump system is provided comprising: a rotary peristaltic pump comprising a stator and a rotor, the rotor driven to rotate about a rotor axis and comprising a plurality of idler rollers arranged radially equidistant about the rotor axis, each roller freely rotating about an own axis parallel to the rotor axis; a flow valve in fluid communication with an output of the pump; a fluid path in fluid communication with the valve and comprising flexible tubing disposed between the plurality of rollers and the stator such that when the rotor is rotated at least one of the plurality of rollers may exert a pressure on the tubing against the stator; a controller in communication with the pump and with the valve, the controller comprising a processor and a memory; and software instructions which when loaded in the memory and executed by the processor effect at the end of a dispensing portion of a dispensing cycle in the following order closing of the valve, operating of the pump to relieve the pressure of the rollers on the tubing, and rotating of the rotor to a start angle.

The pump may further comprise a linear actuator arranged to reciprocate the stator between a first location proximate the rotor and a second location distant from the rotor; and the software instructions when executed to relieve the pressure of the rollers on the tubing may cause the linear actuator to move the stator from the first location to the second location.

In other embodiments, the pump may further comprise a linear actuator arranged to reciprocate the rotor between a first location proximate the rotor and a second location distant from the stator; and the software instructions when executed to relieve the pressure of the rollers on the tubing may cause the linear actuator to move the rotor from the first location to the second location.

In yet other embodiments, the rollers may be retractable into the rotor; and the software instructions when executed to relieve the pressure of the rollers on the tubing may cause the rollers to be retracted.

In a further aspect a method is provided for advancing a determined amount of fluid from a fluid source through a flow valve, the method comprising: providing the fluid source, the flow valve, a rotary peristaltic pump, a controller configured to control the pump and the valve, and a fluid path placing the fluid source in fluid communication with the flow valve through the pump, the pump comprising: a stator; a rotor driven to rotate about a rotor axis, the rotor comprising a plurality of idler rollers arranged radially equidistant about the rotor axis, each roller freely rotating about an own axis parallel to the rotor axis, wherein the fluid path comprises flexible tubing disposed between the rollers and the stator; with the idler rollers exerting pressure on the flexible tubing and the valve open rotating the rotor from a start angle to a dispense angle to advance the determined amount of fluid from the fluid source through the valve; closing the valve after advancing the fluid; relaxing the pressure of the idler rollers on the tubing after closing the valve; with the pressure on the tubing relaxed and the valve closed restoring the rotor to the start angle; re-establishing the pressure of the idler rollers on the tubing; and opening the valve after re-establishing the pressure of the idler rollers on the tubing.

Providing the rotary peristaltic pump may comprise providing the peristaltic pump with the stator arranged to reciprocate between a first location proximate the rotor and a second location distant from the rotor; and relaxing the pressure of the idler rollers on the tubing may comprise moving the stator from the first location to the second location.

In another embodiment of the method, providing the rotary peristaltic pump may comprise providing the peristaltic pump with the rotor arranged to reciprocate between a first location proximate the stator and a second location distant from the stator; and relaxing the pressure of the idler rollers on the tubing may comprise moving the rotor from the first location to the second location.

In yet a further embodiment of the method, providing the rotary peristaltic pump may comprise providing the peristaltic pump with the idler rollers arranged to be retractable into the rotor; and relaxing the pressure of the idler rollers on the tubing may comprise retracting the rollers into the rotor.

In a further aspect, as method is provided for aseptically filling a container with a pharmaceutical fluid, the method comprising: providing a fluid source, a fill needle and container disposed within a sterile isolator, a flow valve, a rotary peristaltic pump, a controller configured to control the pump and the valve, and a fluid path extending between the fluid source and the flow valve and from the valve to the fill needle disposed above an opening of a first container, the pump comprising: a stator; a rotor driven to rotate about a rotor axis, the rotor comprising a plurality of idler rollers arranged radially equidistant about the rotor axis, each roller freely rotating about an own axis parallel to the rotor axis, wherein the fluid path comprises flexible tubing disposed between the rollers and the stator; moving at least one of the container and the fill needle to locate the fill needle over an opening in the container; with the idler rollers exerting pressure on the flexible tubing and the valve open rotating the rotor from a start angle to a dispense angle to advance the determined amount of fluid from the fluid source through the valve and the fill needle into the container; closing the valve after advancing the fluid; relaxing the pressure of the idler rollers on the tubing after closing the valve; with the pressure on the tubing relaxed and the valve closed restoring the rotor to the start angle; re-establishing the pressure of the idler rollers on the tubing; and opening the valve after re-establishing the pressure of the idler rollers on the tubing.

Providing the rotary peristaltic pump may comprise providing the peristaltic pump with the stator arranged to reciprocate between a first location proximate the rotor and a second location distant from the rotor; and relaxing the pressure of the idler rollers on the tubing may comprise moving the stator from the first location to the second location.

In another embodiment of the method, providing the rotary peristaltic pump may comprise providing the peristaltic pump with the rotor arranged to reciprocate between a first location proximate the stator and a second location distant from the stator; and relaxing the pressure of the idler rollers on the tubing may comprise moving the rotor from the first location to the second location.

In yet a further embodiment of the method, providing the rotary peristaltic pump may comprise providing the peristaltic pump with the idler rollers arranged to be retractable into the rotor; and relaxing the pressure of the idler rollers on the tubing may comprise retracting the rollers into the rotor.

In yet a further aspect, a method is provided for aseptically filling a plurality of containers with a pharmaceutical fluid, the method comprising: (a) providing a fluid source, disposed within a sterile isolator a fill needle and the plurality of containers within a container nest, a flow valve, a rotary peristaltic pump, a controller configured to control the pump and the valve, and a fluid path extending between the fluid source and the flow valve and from the valve to the fill needle disposed above an opening of a first container, the pump comprising: a stator; a rotor driven to rotate about a rotor axis, the rotor comprising a plurality of idler rollers arranged radially equidistant about the rotor axis, each roller freely rotating about an own axis parallel to the rotor axis, wherein the fluid path comprises flexible tubing disposed between the rollers and the stator; (b) moving at least one of the container nest and the fill needle to locate the fill needle over an opening of a first of the plurality of containers; (c) with the idler rollers exerting pressure on the flexible tubing and the valve open rotating the rotor from a start angle to a dispense angle to advance the determined amount of fluid from the fluid source through the valve and the fill needle into the first of the plurality of containers; (d) closing the valve after advancing the fluid; (e) relaxing the pressure of the idler rollers on the tubing after closing the valve; (f) with the pressure on the tubing relaxed and the valve closed restoring the rotor to the start angle; (g) re-establishing the pressure of the idler rollers on the tubing; (h) moving at least one of the container nest and the fill needle to locate the fill needle over an opening of another of the plurality of containers; and (i) opening the valve; (j) repeating steps (c) to (i) until the plurality of containers have been filled with fluid.

Providing the rotary peristaltic pump may comprise providing the peristaltic pump with the stator arranged to reciprocate between a first location proximate the rotor and a second location distant from the rotor; and relaxing the pressure of the idler rollers on the tubing may comprise moving the stator from the first location to the second location.

In an alternative embodiment of the method, providing the rotary peristaltic pump may comprise providing the peristaltic pump with the rotor arranged to reciprocate between a first location proximate the stator and a second location distant from the stator; and relaxing the pressure of the idler rollers on the tubing may comprise moving the rotor from the first location to the second location.

In yet a further embodiment of the method, providing the rotary peristaltic pump may comprise providing the peristaltic pump with the idler rollers arranged to be retractable into the rotor; and relaxing the pressure of the idler rollers on the tubing may comprise retracting the rollers into the rotor.

BRIEF DESCRIPTION OF THE DRAWINGS

The features and objects of this invention, and the manner of attaining them, will become more apparent and the invention itself will be better understood by reference to the following description of an embodiment of the invention taken in conjunction with the accompanying drawings, wherein.

Figure 1:
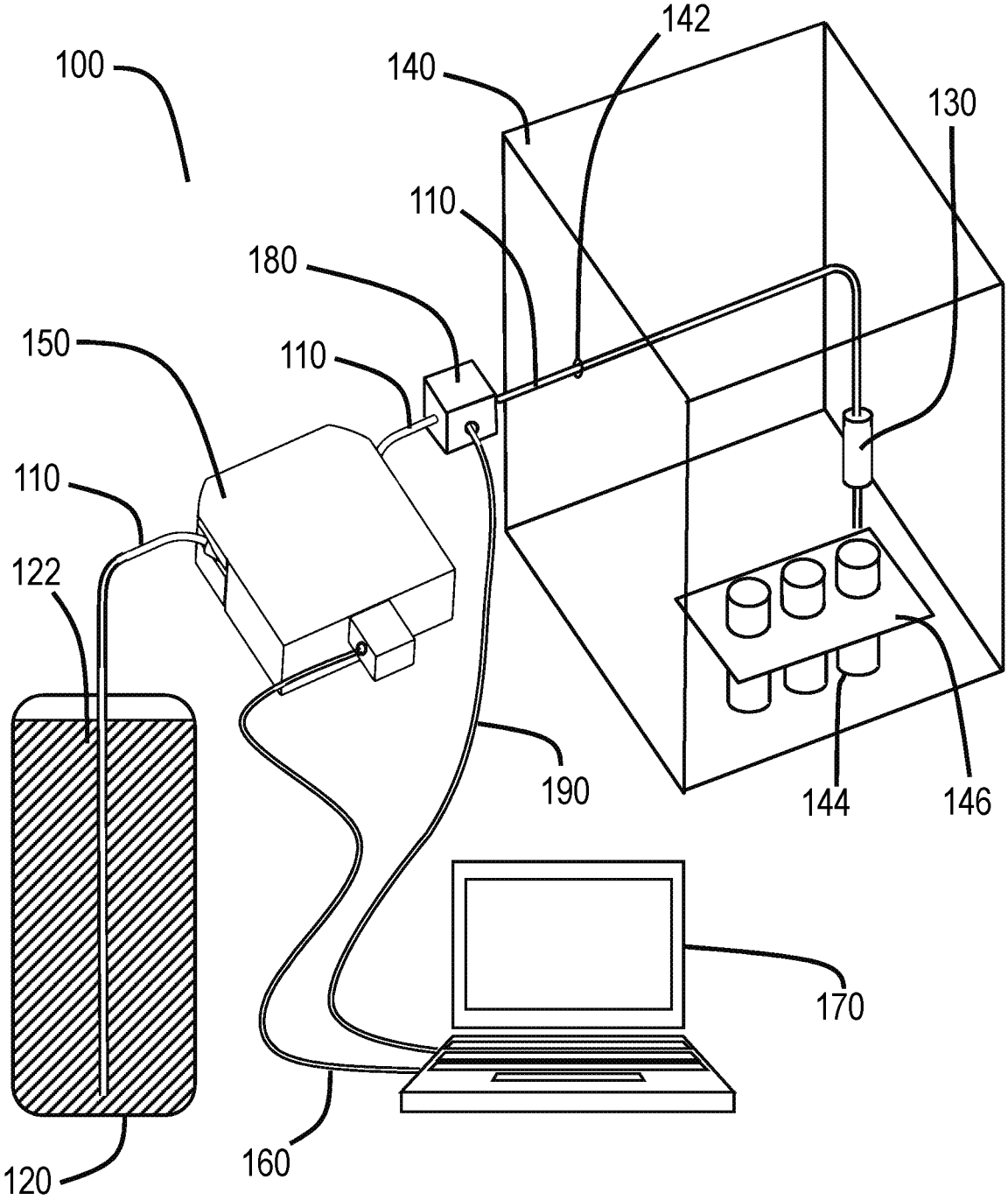
FIG. 1 is a drawing of a first embodiment of a peristaltic pump-based apparatus for filling pharmaceutical containers with a pharmaceutical fluid product.

Corresponding reference characters indicate corresponding parts throughout the several views. Although the drawings represent embodiments of the present invention, the drawings are not necessarily to scale and certain features may be exaggerated in order to better illustrate and explain the present invention. The flow charts are also representative in nature, and actual embodiments of the invention may include further features or steps not shown in the drawings. The exemplification set out herein illustrates an embodiment of the invention, in one form, and such exemplifications are not to be construed as limiting the scope of the invention in any manner.

DESCRIPTION OF EMBODIMENTS OF THE PRESENT INVENTION

The embodiments disclosed below are not intended to be exhaustive or limit the invention to the precise form disclosed in the following detailed description. Rather, the embodiments are chosen and described so that others skilled in the art may utilize their teachings.

Figure 2A:
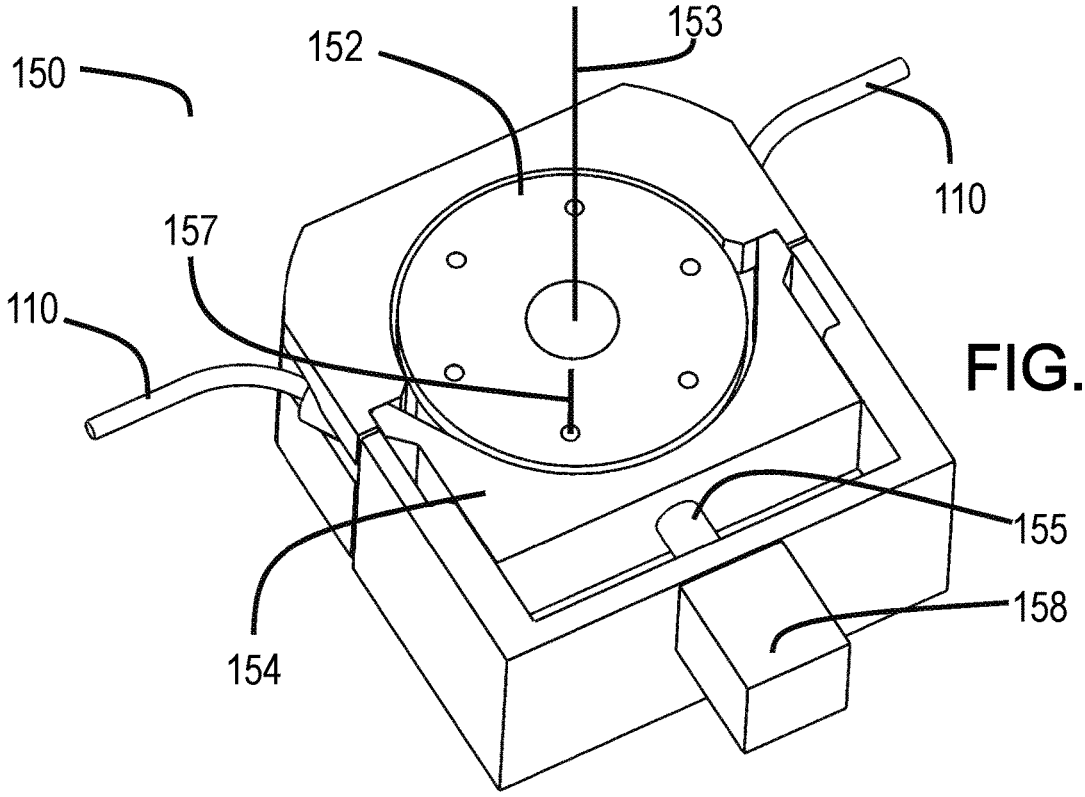
FIG. 2A is close-up view of the peristaltic pump of FIG. 1 with the stator of the pump in a first location.
Figure 2B:
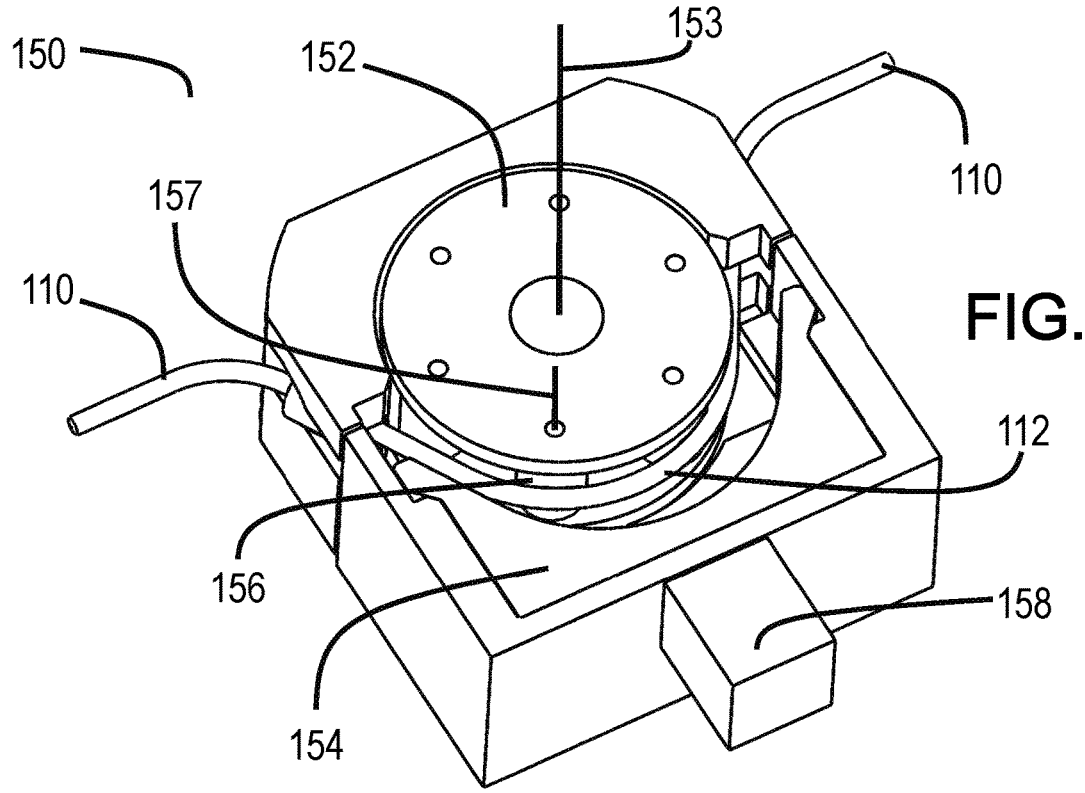
FIG. 2B is close-up view of the peristaltic pump of FIG. 1 with the stator of the pump in a second location.

In FIG. 1, apparatus 100 is shown for aseptically filling container 144 within sterile isolator 140 with pharmaceutical fluid 122 from fluid source container 120 via fluid path 110, peristaltic pump 150 with a precipitating stator, shut-off valve 180, and fill needle 130. Peristaltic pump 150 is controlled by controller 170 via pump control line 160 and shut-off valve 180 is controlled by controller 170 via valve control line 190. Fluid path 110 enters sterile isolator 140 via port 142, which may be hermetically sealed in order to retain the sterile state of the interior of isolator 140. At least within pump 150, the fluid path is defined by flexible tube 112, as shown in FIG. 2B FIG. 2A and FIG. 2B show peristaltic pump 150 of FIG. 1 in more detail and in two different states. Pump 150 comprises rotor 152 driven about rotor axis 153, rotor 152 bearing a plurality of idler rollers 156 arranged radially equidistant about rotor axis 153 and free to rotate about axes 157 parallel to rotor axis 153. Reciprocating stator 154 reciprocates along the direction of shaft 155 under the action of actuator 158. Actuator 158 is under the control of controller 170 of FIG. 1. Stator 154 is arranged to reciprocate between a first location proximate rotor 152, as shown in FIG. 2A, and a second location distant from rotor 152, as shown in FIG. 2B, flexible tubing 110 being disposed between at least one of the plurality of idler rollers 156 and stator 154, as may also be seen in FIG. 2B. When stator 154 is in the first location, idler rollers 156 exert pressure on flexible tubing 110 and pump 150 functions as a classic peristaltic pump, rollers 156 advancing fluid 122 along flexible tube 112 as they move and rotate around their own axes 157 during rotation of rotor 152. In FIG. 1, and in FIG. 2A and FIG. 2B, the rotation of rotor 152 is anti-clockwise when advancing fluid 122 from left to right through tube 112 in the diagrams. When stator 154 is in the second location, rollers 156 do not exert pressure on flexible tubing 112 and rotor 152 may be rotated without advancing fluid 122 through tube 112.

Figure 3A:
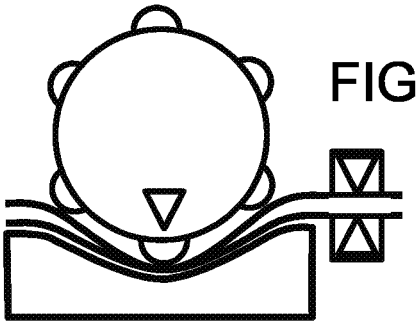
FIG. 3A to FIG. 3G shows a series of steps in operating the peristaltic pump-based apparatus of FIG. 1.
Figure 3B:
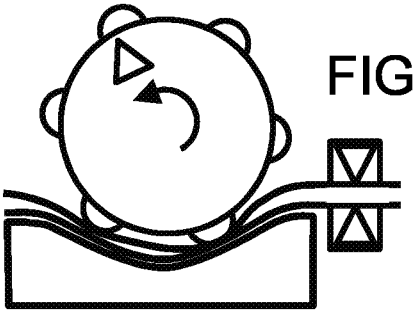
Figure 3C:
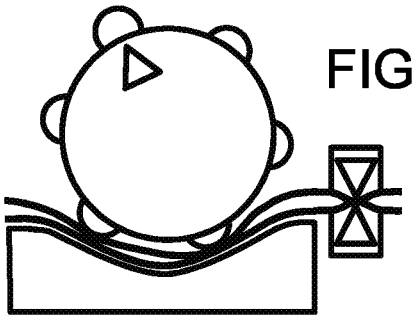
Figure 3D:
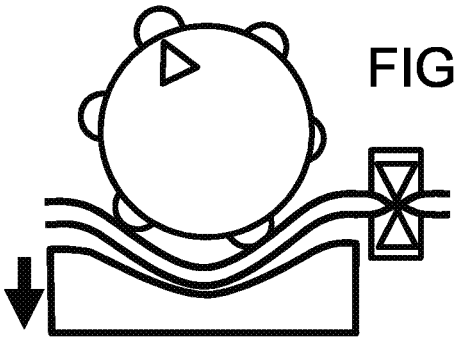
Figure 3E:
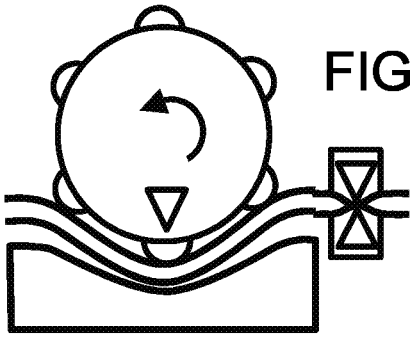
Figure 3F:
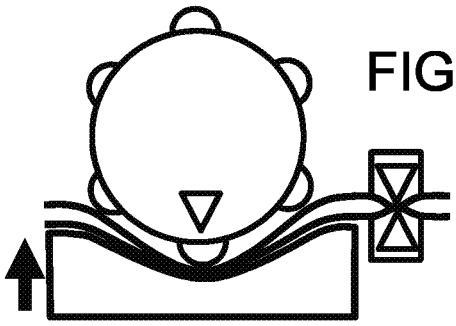
Figure 3G:
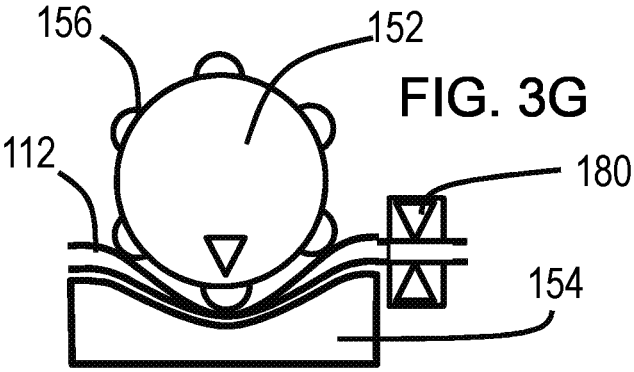

FIG. 3A-G schematically show a series of states of valve 180 of FIG. 1 and of peristaltic pump 150 of FIG. 2A and FIG. 2B as part of the operating of system 100 of FIG. 1. In the interest of clarity, only FIG. 3G is labeled, thereby avoiding obfuscation of the series of schematics. Purely for the purposes of explanation of the operation, rotor 152 is labeled with a triangle in this series of schematics, the triangle serving as reference to show the angle of rotation of rotor 152. FIG. 3A shows pump 150 with stator 154 in the first location proximate the rotor and compressing flexible tube 112 against one of rotors 156. Rotor 152 is shown as rotating anti-clockwise to advance fluid to the right and through valve 180, valve 180 being open to allow through the fluid. Within FIG. 1, the fluid is being advanced to dispensing needle 130 when pump 150 and valve 180 are in the state shown in FIG. 3A.

FIG. 3B shows rotor 152 as having rotated through a dispensing angle required for a single dispensing cycle. For the sake of explaining the working of this system, the dispensing angle is taken to be approximately 210 degrees, or multiple of 360 degrees plus 210 degrees. The angle selected in a practical dispensing cycle would be based on the amount of fluid required to be dispensed. At this point in the cycle, valve 180 is still open. FIG. 3C represents the next step in the dispensing cycle in which valve 180 is closed. FIG. 3A-C together therefore represent the dispensing portion of the dispensing cycle.

In FIG. 3D, stator 154 is moved to the second location distant from rotor 152, thereby relieving the pressure on tube 112. FIG. 3E shows rotor 152 rotated to return it to its starting angle while valve 180 is still closed and stator 154 is still in the second location. Since rollers 156 are not exerting pressure on tube 112 during this rotation, no fluid is being advanced. In some embodiments, the relative movement of the rotor and stator involves physically removing the plurality of rollers from contacting the tubing. There is also no wear on the tube 112. In FIG. 3F, stator 154 is moved back to the first location, thereby restoring the pressure on tube 112, while FIG. 3G shows valve 180 opened, so that FIG. 3G restores the system to exactly the same state as in FIG. 3A, ready to initiate a next dispensing cycle. FIGS. 3D-G therefore show the reset portion of the dispensing cycle, one complete dispensing cycle comprising a dispensing portion and a reset portion.

All of the above steps may be executed automatically by controller 170 operating actuator 158 via pump control line 160 and valve 180 via valve control line 190, and alternatively controller 170 may wirelessly control actuator 158 and valve 180 through a telecommunications protocol, e.g. Bluetooth or Wi-Fi. To this end, controller 170 may comprise among its hardware a processor and a memory. A set of instructions may be loaded into the memory. The instructions, when executed by the processor, may perform the steps of: moving stator 154 to the first location, opening valve 180, and then rotating rotor 152 from a start angle to a dispense angle to allow a determined amount of fluid to flow from fluid source 120 through fluid path 110 and through valve 180; and, subsequent to rotating rotor 152 to the dispense angle, closing valve 180, relaxing pressure on tubing 112 by moving stator 154 to the second location, and then restoring rotor 152 to the start angle without causing fluid to flow through valve 180. When a plurality of dispenses into a plurality of containers 144 need to be made, controller 170 may repeat the cycle described above for each of containers 144 in the plurality of containers.

Figure 4:
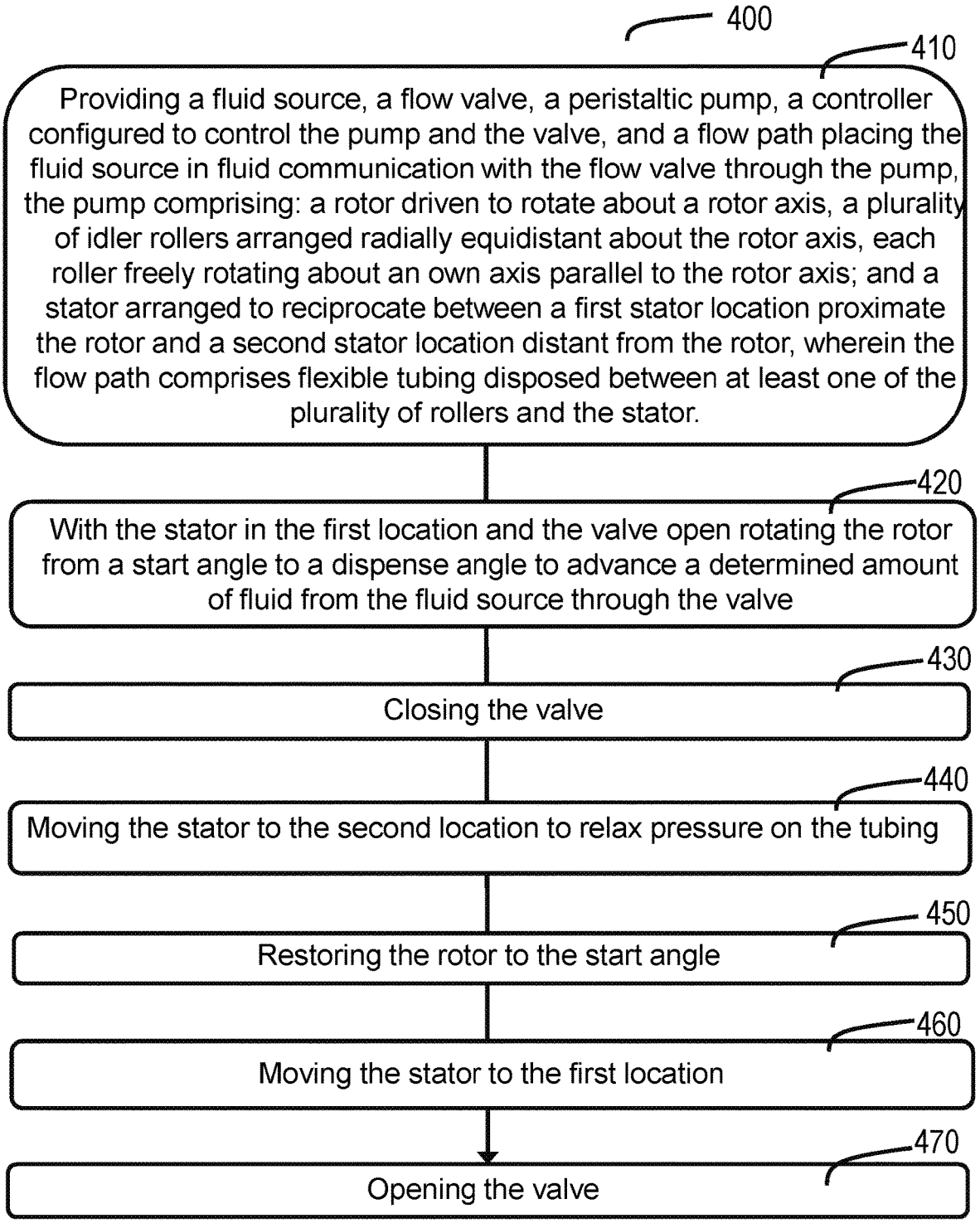
FIG. 4 is a flow diagram of a method for advancing a determined amount of fluid from a fluid source through a flow valve by means of a peristaltic pump having a reciprocating stator FIG. 5A to FIG. 5G shows a series of steps in operating a peristaltic pump-based apparatus of FIG. 1 using an alternative embodiment of the pump

In another aspect, described at the hand of the flow chart of FIG. 4 and the apparatus of FIG. 1, FIG. 2A and FIG. 2B, as well as FIG. 3A-G, there is presented method [400] for aseptically filling first container 144 with pharmaceutical fluid 122, the method comprising: providing [410] fluid source 120, flow valve 180, rotary peristaltic pump 150, controller 170 configured to control pump 150 and valve 180, and fluid path 110 extending between fluid source 120 and flow valve 180 and from valve 180 to fill needle 130 disposed above an opening of first container 144, pump 150 comprising: rotor 152 driven to rotate about rotor axis 153, a plurality of idler rollers 156 arranged radially equidistant about rotor axis 153, each roller 156 freely rotating about an own axis 157 parallel to rotor axis 153; and stator 154 arranged to reciprocate between a first location proximate rotor 152 and a second location distant from rotor 152, wherein fluid path 110 comprises flexible tubing 112 disposed between at least one of the plurality of rollers 156 and stator 154; with stator 154 in the first location and valve 180 open rotating [420] rotor 152 from a start angle to a dispense angle to advance a determined amount of fluid 122 from fluid source 120 through fluid path 110 and through valve 180 to fill needle 130; closing [430] valve 180; moving [440] stator 154 to the second location to relax pressure on tubing 112; restoring [450] rotor 152 to the start angle; moving [460] stator 154 to the first location; and opening [470] valve 180.

Method [400] may further comprise providing first container 144 as one of a plurality of containers held in container nest 146. The method may yet further comprise, after rotating [420] rotor 152 from a start angle to a dispense angle and closing [430] valve 180, one of moving an opening of a second of the plurality of containers under fill needle 130 and moving fill needle 130 to be above an opening of a second of the plurality of containers. Moving an opening of the second of the plurality of containers may comprise moving container nest 146. The method may further comprise repeating steps [420] to [470] to advance again the determined amount of fluid 122 from fluid source 120 along fluid path 110 through tubing 112 and through valve 180 to fill needle 130 and from there into the second of the plurality of containers.

In another implementation, the pressure on tube 112 is relieved not by moving stator 154, but to instead reciprocate rotor 152 between a first location proximate stator 154 and a second location distant from stator 154. In this implementation, stator 154 is kept stationary and the rest of peristaltic pump 150 is allowed to move with respect to stator 154 under the action of actuator 158.

In this implementation, FIG. 2A and FIG. 2B may be viewed as showing peristaltic pump 150 of FIG. 1 in more detail and in two different states. Pump 150 comprises rotor 152 driven about rotor axis 153, rotor 152 bearing a plurality of idler rollers 156 arranged radially equidistant about rotor axis 153 and free to rotate about axes 157 parallel to rotor axis 153. Reciprocating rotor 152 reciprocates along the direction of shaft 155 under the action of actuator 158. Actuator 158 is under the control of controller 170 of FIG. 1. Rotor 152 is arranged to reciprocate between a first location proximate stator 154, as shown in FIG. 2A, and a second location distant from stator 154, as shown in FIG. 2B, flexible tubing 112 being disposed between at least one of the plurality of idler rollers 156 and stator 154, as may also be seen in FIG. 2B. When rotor 152 is in the first location, idler rollers 156 exert pressure on flexible tubing 112 and pump 150 functions as a classic peristaltic pump, rollers advancing fluid 122 along tube 112 as they move and rotate around their own axes 157 during rotation of rotor 152. In FIG. 1 and in FIG. 2A and FIG. 2B, the rotation of rotor 152 is anti-clockwise when advancing fluid 122 from left to right through tube 112 in the diagrams. When rotor 152 is in the second location, rollers 156 do not exert pressure on flexible tubing 112 and rotor 152 may be rotated without advancing fluid 122 through tube 112.

Figure 5A:
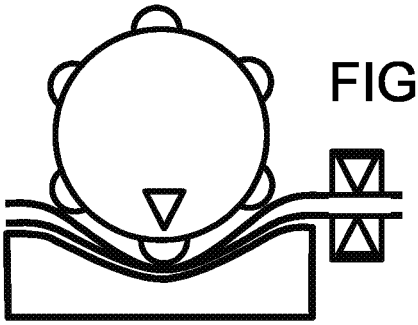
Figure 5B:
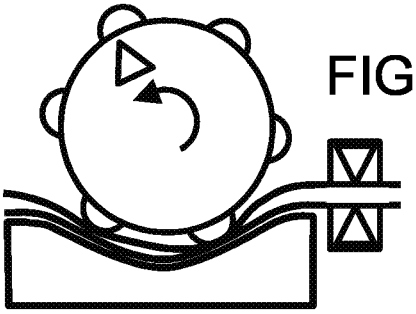
Figure 5C:
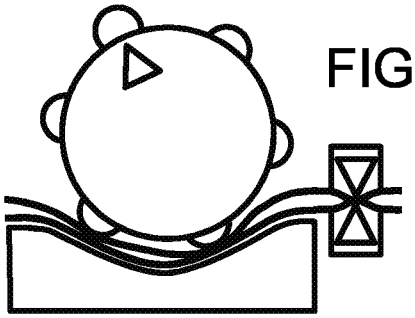
Figure 5D:
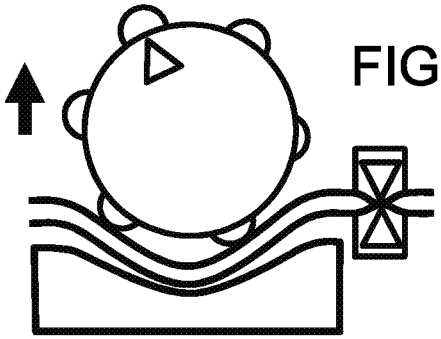
Figure 5E:
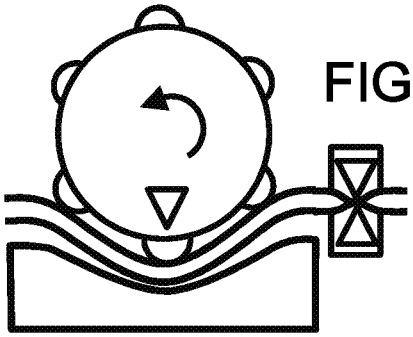
Figure 5F:
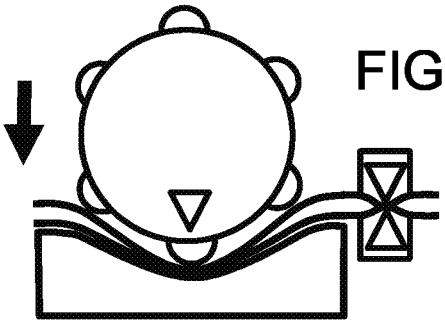
Figure 5G:
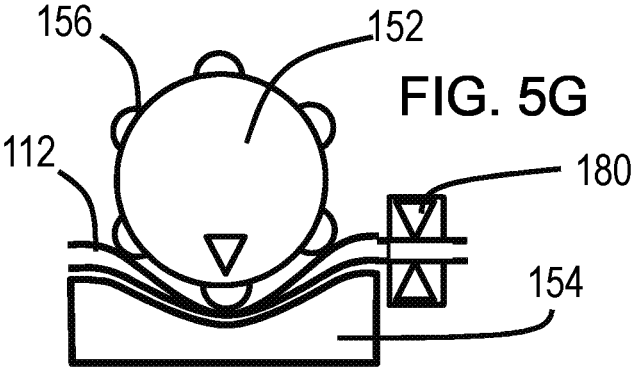

FIGS. 5A-G schematically show a series of states of valve 180 of FIG. 1 and of peristaltic pump 150 of FIG. 2A and FIG. 2B as part of the operating of system 100 of FIG. 1. In the interest of clarity, only FIG. 5G is labeled, thereby avoiding obfuscation of the series of schematics. Purely for the purposes of explanation of the operation, rotor 152 is labeled with a triangle in this series of schematics, the triangle serving as reference to show the angle of rotation of rotor 152. FIG. 5A shows pump 150 with rotor 152 in the first location proximate stator 154 and at least one of idler rollers 156 compressing flexible tube 112 against rotor 152. Rotor 152 is shown as rotating anti-clockwise to advance fluid to the right and through valve 180, valve 180 being open to allow through the fluid. Within FIG. 1, the fluid is being advanced to dispensing needle 130 when pump 150 and valve 180 are in the state shown in FIG. 5A.

FIG. 5B shows rotor 152 as having rotated through a dispensing angle required for a single dispensing cycle. For the sake of explaining the working of this system, the dispensing angle is taken to be approximately 210 degrees, or multiple of 360 degrees plus 210 degrees. The angle selected in a practical dispensing cycle would be based on the amount of fluid required to be dispensed. At this point in the cycle, valve 180 is still open. FIG. 5C represents the next step in the dispensing cycle in which valve 180 is closed. FIG. 5A-C together therefore represent the dispensing portion of the dispensing cycle.

In FIG. 5D, rotor 152 is moved to the second location distant from stator 154, thereby relieving the pressure on tube 112. FIG. 5E shows rotor 152 rotated to return it to its starting angle while valve 180 is still closed and rotor 152 is still in the second location. Since rollers 156 are not exerting pressure on tube 112 during this rotation, no fluid is being advanced, nor is any fluid being discharged or otherwise diverted. There is also no wear on tube 112. In FIG. 5F, rotor 152 is moved back to the first location, thereby restoring the pressure on tube 112, while FIG. 5G shows valve 180 opened, so that FIG. 5G restores the system to exactly the same state as in FIG. 5A, ready to initiate a next dispensing cycle. FIGS. 5D-G therefore show the reset portion of the dispensing cycle, one complete dispensing cycle comprising a dispensing portion and a reset portion.

All of the above steps may be executed automatically by controller 170 operating actuator 158 via pump control line 160 and valve 180 via valve control line 190. To this end, controller 170 may comprise among its hardware a processor and a memory, and alternatively controller 170 may wirelessly control actuator 158 and valve 180 through a telecommunications protocol, e.g. Bluetooth or Wi-Fi. A set of instructions may be loaded into the memory. The instructions, when executed by the processor, may perform the steps of: moving rotor 152 to the first location, opening valve 180, and then rotating rotor 152 from a start angle to a dispense angle to allow a determined amount of fluid to flow from fluid source 120 along flow path 110 through tubing 112 and through valve 180; and, subsequent to rotating rotor 152 to the dispense angle, closing valve 180, relaxing pressure on tubing 112 by moving rotor 152 to the second location, and then restoring rotor 152 to the start angle without causing fluid to flow through valve 180. When a plurality of dispensings into a plurality of containers 144 need to be made, controller 170 may repeat the cycle described above for each of containers 144 in the plurality of containers.

Figure 6:
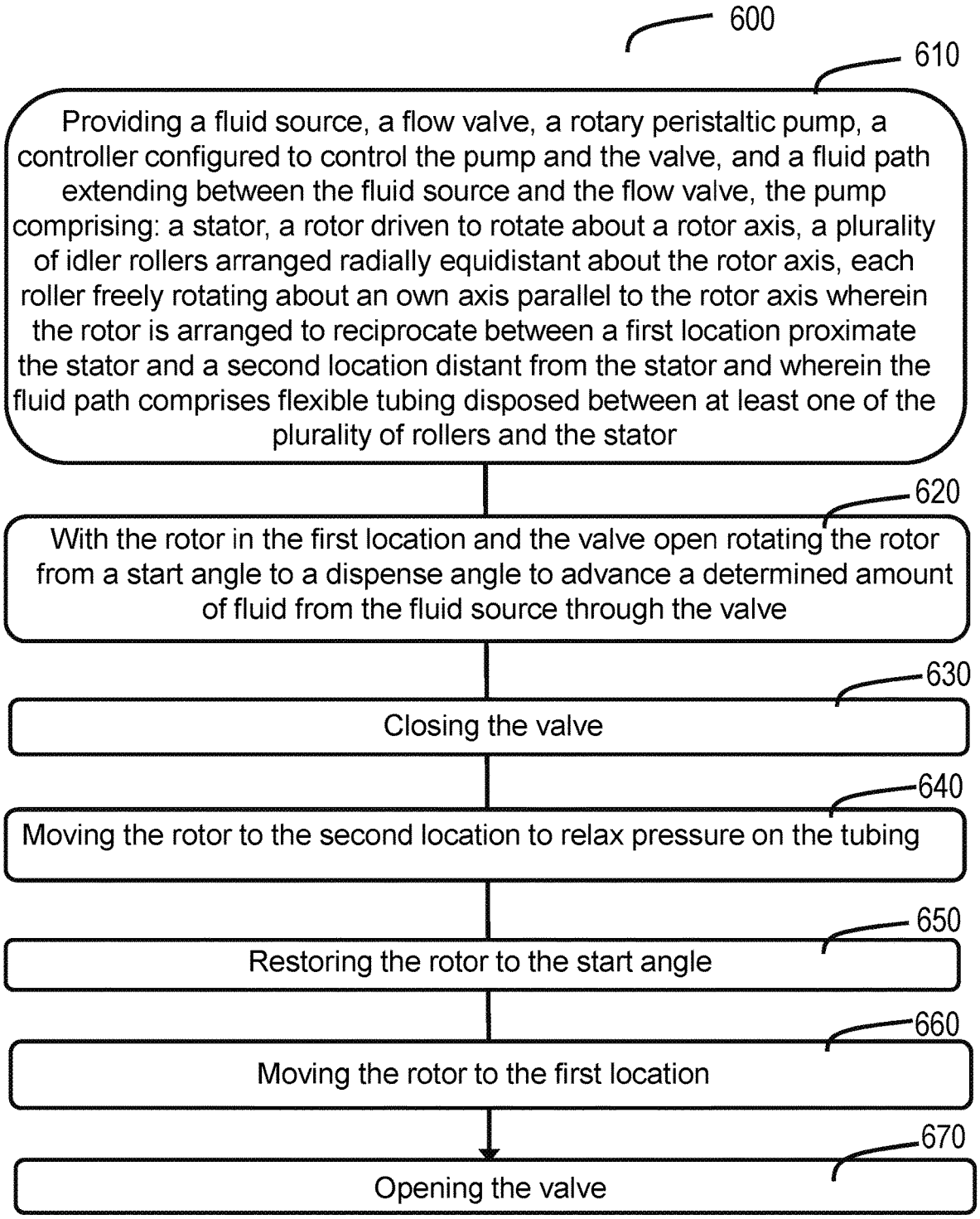
FIG. 6 is a flow diagram of a method of advancing a determined amount of fluid from a fluid source through a flow valve by means of a peristaltic pump having a reciprocating rotor.

In another aspect, described at the hand of the flow chart of FIG. 6 and the apparatus of FIG. 1, FIG. 2A and FIG. 2B, as well as FIG. 5A-G, there is presented method [600] for aseptically filling first container 144 with pharmaceutical fluid 122, the method comprising: providing [610] fluid source 120, flow valve 180, rotary peristaltic pump 150, controller 170 configured to control pump 150 and valve 180, and fluid path 110 extending between fluid source 120 and flow valve 180 and from valve 180 to fill needle 130 disposed above an opening of first container 144, pump 150 comprising: stator 154, rotor 152 driven to rotate about rotor axis 153, a plurality of idler rollers 156 arranged radially equidistant about rotor axis 153, each roller 156 freely rotating about an own axis 157 parallel to rotor axis 153 wherein rotor 152 is arranged to reciprocate between a first location proximate stator 154 and a second location distant from stator 154, wherein fluid path 110 comprises flexible tubing 112 disposed between at least one of the plurality of rollers 156 and stator 154; with rotor 152 in the first location and valve 180 open rotating [620] rotor 152 from a start angle to a dispense angle to advance a determined amount of fluid 122 from fluid source 120 along fluid path 110 through tubing 112 and through valve 180 to fill needle 130; closing [630] valve 180; moving [640] rotor 152 to the second location to relax pressure on tubing 112; restoring [650] rotor 152 to the start angle; moving [660] rotor 152 to the first location; and opening [670] valve 180.

Method [600] may further comprise providing first container 144 as one of a plurality of containers held in container nest 146. The method may yet further comprise, after rotating [620] rotor 152 from a start angle to a dispense angle and closing [630] valve 180, one of moving an opening of a second of the plurality of containers under fill needle 130 and moving fill needle 130 to be above an opening of a second of the plurality of containers. Moving an opening of the second of the plurality of containers may comprise moving container nest 146. The method may further comprise repeating steps [620] to [670] to advance again the determined amount of fluid 122 along fluid path 110 from fluid source 120 through tubing 112 and through valve 180 to fill needle 130 and from there into the second of the plurality of containers.

In an embodiment of a second implementation of system 100 of the present invention shown in FIG. 1, further mechanisms for reciprocating the rotor between the first and the second rotor locations are contemplated, the further mechanisms comprising moving only the rotor and no other portions of the pump, or moving as little mass as possible in addition to the rotor.

Figure 7:
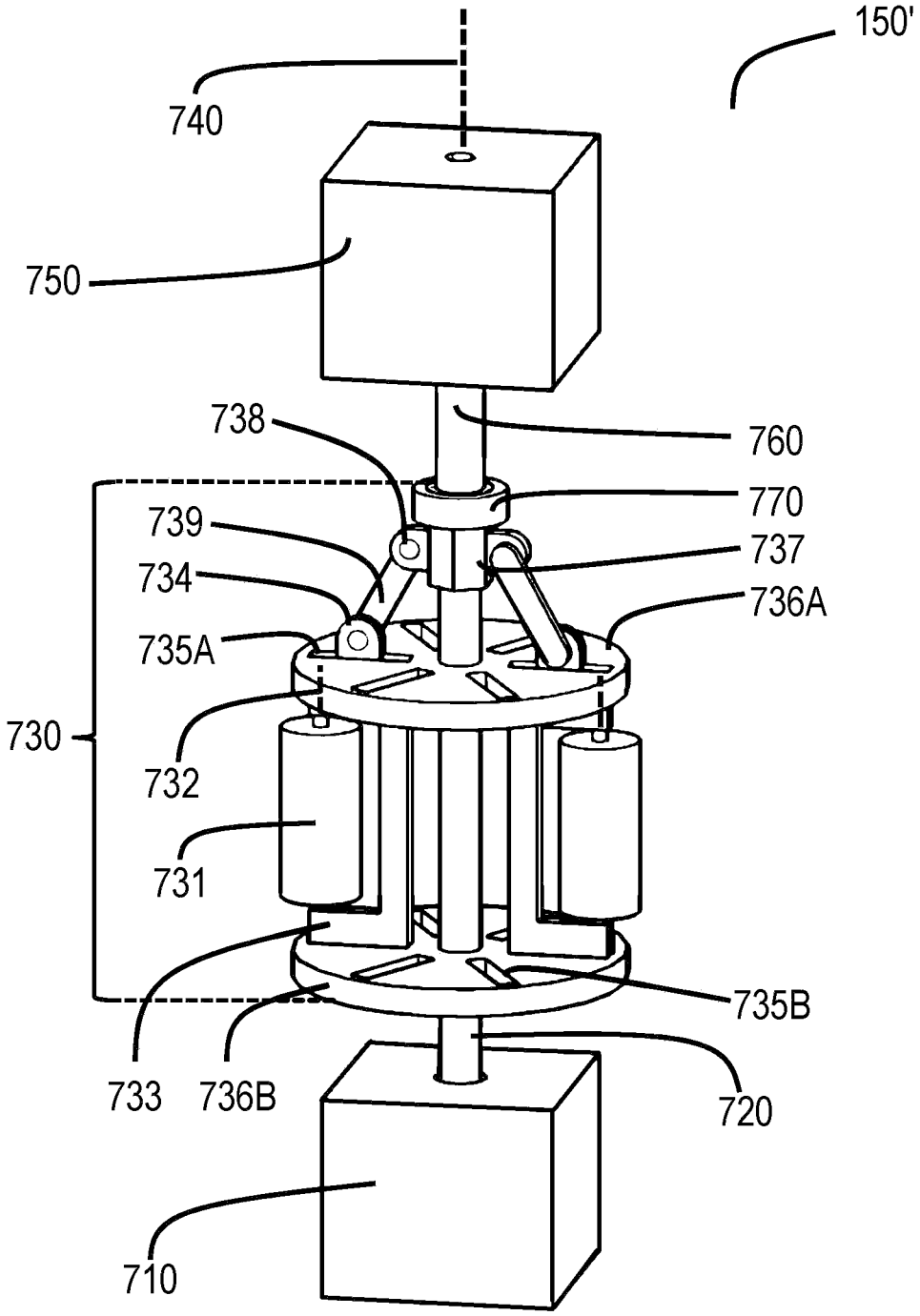
FIG. 7 is a view of an alternative embodiment of the peristaltic pump of FIG. 1 wherein the pump has retractable idler rollers. For purposes of clarity, the stator of the pump is not shown and only two idler rollers are shown.

In yet a further implementation of the system of FIG. 1, the idler rollers of the rotor do not rotate about fixed axes arranged about the rotor axis. Instead, as shown in FIG. 7, rollers 731 are retractable into rotor 730 to a degree that relieves the pressure on tube 112 bearing fluid 122. In such an implementation, there is no requirement for either the rotor or the stator to reciprocate during operation of the pump, as rollers 731 may be retracted during the reset portion of the dispensing cycle.

In FIG. 7, rotary peristaltic pump 150' is shown with its stator and tubing omitted for the sake of clarity. Pump 150' may be employed in the same arrangement as in FIG. 1, in which arrangement it replaces pump 150. Pump engine 710 drives pump axle 720 on which is mounted rotor 730, thereby driving rotor 730 to rotate about pump axis 740. Axis 740 also serves as rotor axis. Linear actuator 750 is arranged to extend and retract actuator rod 760 along axis 740. Actuator rod 760 is fixed to the inner ring of ball bearing 770, allowing thereby the outer ring of ball bearing 770, along with all systems attached to that outer ring, to rotate freely about actuator rod 760. Bushing 737 comprising six linkage mounts 738 is mounted fixedly to the outer ring of ball bearing 760. For the sake of clarity, only two linkage mounts 738 are shown in FIG. 1 of which only one is labeled. Rotor 730 further comprises first and second rotor assembly plates 736A and 736B which each engage with six idler roller subassemblies to be described below. For the sake of clarity only two of the six idler roller subassemblies are shown in FIG. 1, and only one of the two has numbered elements. In, general rotor 730 may comprise any number of idler roller subassemblies.

Idler rollers 731 are held in roller mounts 733 which allow rollers 731 to rotate freely about roller axes 732. Each of roller mounts 733 has two linkage mounts 734, one for sliding within slide guide 735A in rotor assembly plate 736A, and another obscured by rotor assembly plate 736B and arranged for sliding in a slide guide (obscured in FIG. 1) within rotor assembly plate 736B. With four of the idler roller assemblies omitted from FIG. 1, four of slide guides 735B in rotor assembly plate 736B are visible. Linkage mount 734 is connected to linkage mount 738 on bushing 737 by linkage 739. Linkage 739 is free to rotate with linkage mount 734 and within linkage mount 738.

In operation, linear actuator 750 may extend actuator rod 760 along pump axis 740 and thereby causes bushing 737 to move closer to rotor assembly plate 736A. This causes linkage 739 to rotate with both linkage mounts 734 and 738 and to exert a lateral force on rotor mount 733, which in turn causes linkage mounts 734 to slide outward within their respective slide guides. This action positions idler rollers 731 further from pump axis 740. With reference to FIG. 8, when extended in this fashion, rollers 731 may exert pressure on flexible tubing 112 in pump 150' by pressing flexible tubing 112 against suitable stator 780. When linear actuator 750 retracts rod 760, that pressure is relieved.

Figure 8A:
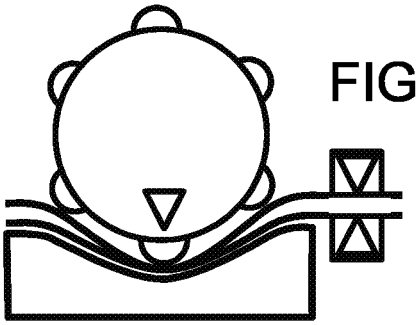
FIG. 8A to FIG. 8G shows a series of steps in operating the peristaltic pump-based apparatus of FIG. 1 employing the pump of FIG. 7.
Figure 8B:
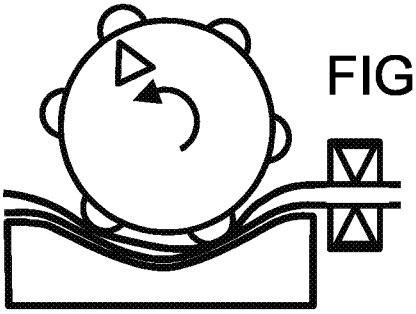
Figure 8C:
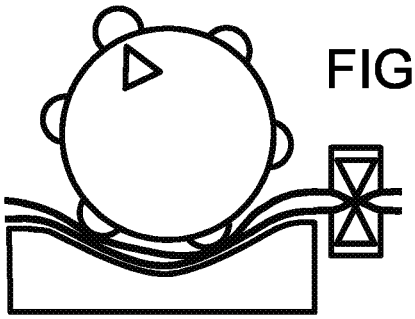
Figure 8D:
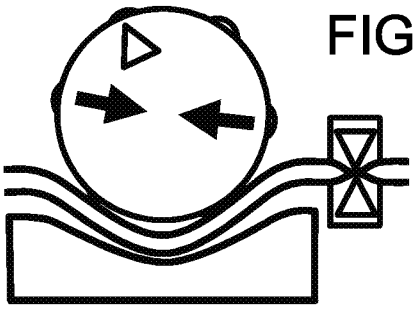
Figure 8E:
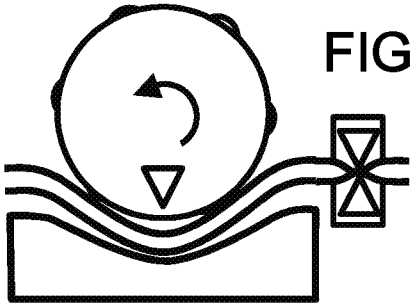
Figure 8F:
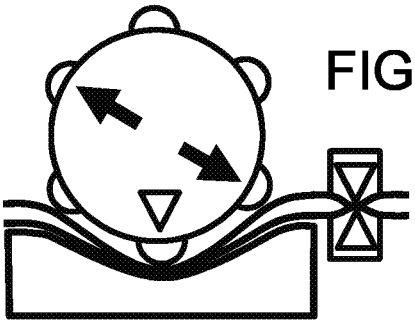
Figure 8G:
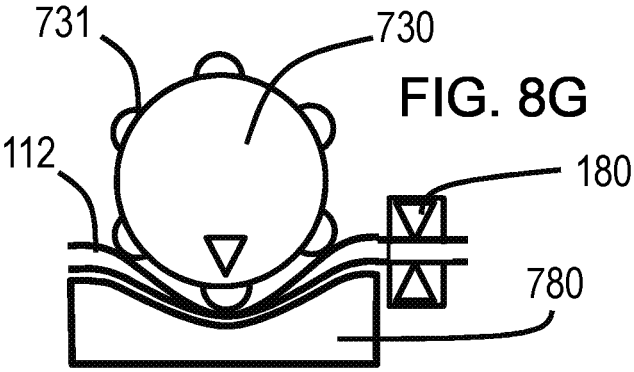

FIGS. 8A-G schematically show a series of states of valve 180 of FIG. 1 and of peristaltic pump 150' of FIG. 7 as part of the operating of system 100 of FIG. 1. In the interest of clarity, only FIG. 8G is labeled, thereby avoiding obfuscation of the series of schematics. Purely for the purposes of explanation of the operation, rotor 730 is labeled with a triangle in this series of schematics, the triangle serving as reference to show the angle of rotation of rotor 730. FIG. 8A shows pump 150' with at least one of idler rollers 731 compressing flexible tube 112 against stator 780. Rotor 730 is shown as rotating anti-clockwise to advance fluid to the right and through valve 180, valve 180 being open to allow through the fluid. Within FIG. 1, the fluid is being advanced to dispensing needle 130 when pump 150' and valve 180 are in the state shown in FIG. 8A.

FIG. 8B shows rotor 152 as having rotated through a dispensing angle required for a single dispensing cycle. For the sake of explaining the working of this system, the dispensing angle is taken to be approximately 210 degrees, or multiple of 360 degrees plus 210 degrees. The angle selected in a practical dispensing cycle would be based on the amount of fluid required to be dispensed. At this point in the cycle, valve 180 is still open. FIG. 8C represents the next step in the dispensing cycle in which valve 180 is closed. FIG. 8A-C together therefore represent the dispensing portion of the dispensing cycle.

In FIG. 8D, linear actuator 750 retracts actuator rod 760 to retract idler rollers 731 closer to pump axis 740, relieving thereby the pressure on tube 112. FIG. 8E shows rotor 730 rotated to return it to its starting angle while valve 180 is still closed and rotor 730 is still in the second location. Since rollers 731 are not exerting pressure on tube 112 during this rotation, no fluid is being advanced. There is also no wear on tube 112. In FIG. 8F, linear actuator 750 extends rod 760 back to its prior position, thereby restoring rollers 731 to their prior positions relative to axis 740, thereby re-establishing the pressure of rollers 731 on tube 110. FIG. 8G shows valve 180 opened, thereby restoring system to exactly the same state as in FIG. 8A, ready to initiate a next dispensing cycle. FIGS. 8D-G therefore show the reset portion of the dispensing cycle, one complete dispensing cycle comprising a dispensing portion and a reset portion.

All of the above steps may be executed automatically by controller 170 operating actuator 750 via pump control line 160 and valve 180 via valve control line 190. To this end, controller 170 may comprise among its hardware a processor and a memory, and alternatively controller 170 may wirelessly control actuator 158 and valve 180 through a telecommunications protocol, e.g. Bluetooth or Wi-Fi. A set of instructions may be loaded into the memory. The instructions, when executed by the processor, may perform the steps of: extending rollers 731 to a first radial distance from pump axis 740, opening valve 180, and then rotating rotor 730 from a start angle to a dispense angle to allow a determined amount of fluid to flow from fluid source 120 along fluid path 110 through tubing 112 and through valve 180; and, subsequent to rotating rotor 730 to the dispense angle, closing valve 180, relaxing pressure on tubing 112 by retracting rollers 731 to a second radial distance closer to pump axis 740, and then restoring rotor 730 to the start angle without causing fluid to flow through valve 180. When a plurality of dispensings into a plurality of containers 144 need to be made, controller 170 may repeat the cycle described above for each of the containers 144 in the plurality of containers.

Figure 9:
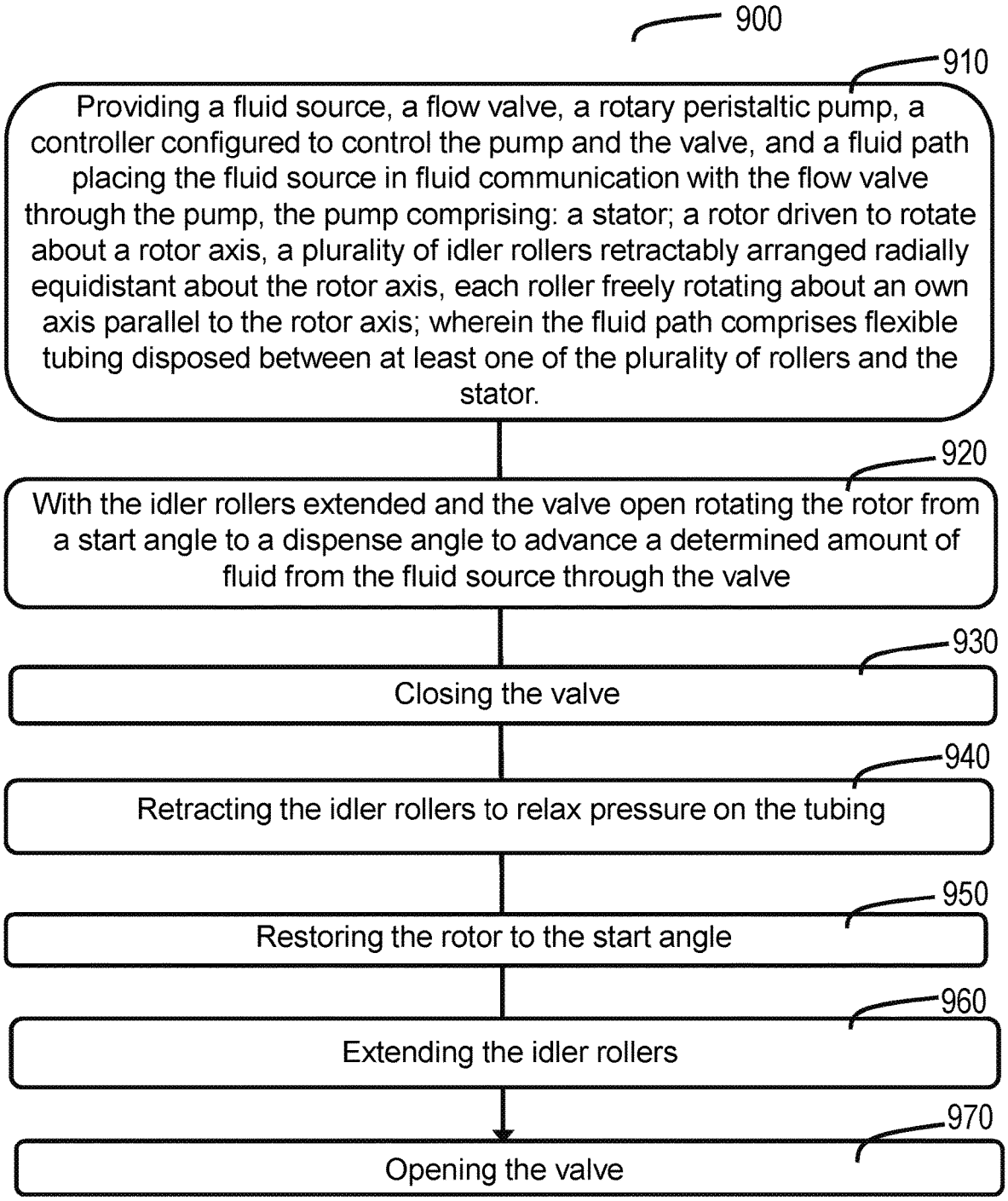
FIG. 9 is a flow diagram of a method for advancing a determined amount of fluid from a fluid source through a flow valve by means of a peristaltic pump having retractable rotors.

With reference to FIG. 1, FIG. 7 and FIGS. 8A-E, along with the flow chart in FIG. 9, there is presented method [900] for aseptically filling first container 144 with pharmaceutical fluid 122, the method comprising: providing [910]

fluid source 120, flow valve 180, rotary peristaltic pump 150', controller 170 configured to control pump 150' and valve 180, and fluid path 110 placing fluid source 120 in fluid communication with flow valve 180 through pump 150', pump 150' comprising: a stator 780; a rotor 730 driven to rotate about rotor axis 740, a plurality of idler rollers 731 retractably arranged radially equidistant about rotor axis 740, each roller freely rotating about an own roller axis 732 parallel to rotor axis 740 wherein fluid path 110 comprises flexible tubing 112 disposed between at least one of the plurality of rollers 731 and stator 780; with idler rollers 731 extended and valve 180 open rotating [920] rotor 730 from a start angle to a dispense angle to advance a determined amount of fluid 122 from fluid source 120 through valve 180 and to dispensing needle 130; closing [930] valve 180; retracting [940] idler rollers 731 to relax pressure on tubing 112; restoring [950] rotor 730 to the start angle; extending [960] idler rollers 731 to establish pressure on tubing 112; and opening [970] valve 180.

Method [900] may further comprise providing first container 144 as one of a plurality of containers held in container nest 146. The method may yet further comprise, after rotating [920] rotor 730 from a start angle to a dispense angle and closing [930] valve 180, one of moving an opening of a further one of the plurality of containers under fill needle 130 and moving fill needle 130 to be above an opening of a second of the plurality of containers. The moving the opening of the further one of the plurality of containers may comprise moving container nest 146. The method may further comprise repeating steps [920] to [970] to advance the determined amount of fluid 122 along fluid path 110 from fluid source 120 through tubing 112 and through valve 180 to fill needle 130 and from there into further ones of the plurality of containers 144 until the plurality of containers 144 have been filled with fluid.

In any of the embodiments of the present invention, the only portion of the fluid path that is required to be a flexible tube is the portion acted upon by the idler rollers. The fluid path from fluid source 120 to pump 150, 150', and/or the fluid path from pump 150, 150' to flow valve 180, and/or the fluid path from flow valve 180 to fill needle 130 may be, for example, rigid medical grade stainless steel or made of another material that meets pharmaceutical specifications. Flow valve 180 may also be mounted directly on the output of pump 150, 150'. In any of the embodiments of the present invention, the moving of container nest 146 may be by means of a conveyor belt; a robotic arm as described in US Patent Application Publication US 2009/0223592 A1 and in PCT Application Publication Number WO 2013/016248 A1, both wholly incorporated herein by reference; by means of a rotary stage as described in US Patent Application Publication US 2018/0072446 A1, wholly incorporated herein by reference; or by any precision means compatible with the environmental requirements of chamber 140. In other embodiments, fill needle 130 may be moved by suitable means, for example without limitation, a robotic arm, including, without limitation, an articulated robotic arm.

Each of the three embodiments of the method for advancing a determined amount of fluid 122 from fluid source 120 through flow valve 180 comprises: providing fluid source 120, flow valve 180, rotary peristaltic pump 150, 150', controller 170 configured to control pump 150, 150' and valve 180, and fluid path 110 placing fluid source 120 in fluid communication with flow valve 180 through pump 150, 150', pump 150, 150' comprising: stator 154, 780; rotor 152, 730 driven to rotate about rotor axis 153, 740, rotor 152, 730 comprising a plurality of idler rollers 156, 731 arranged radially equidistant about rotor axis 153, 740, each roller 156, 731 freely rotating about an own roller axis 157, 732 parallel to rotor axis 153,740 wherein fluid path 110 comprises flexible tubing 112 disposed between rollers 156, 731 and stator 154, 780; rotating rotor 152, 730 from a start angle to a dispense angle with idler rollers 156, 731 exerting pressure on flexible tubing 112 and valve 180 open to advance the determined amount of fluid from fluid source 120 through valve 180 and to dispensing needle 130; closing valve 180; relaxing the pressure of idler rollers 156, 731 on tubing 112; restoring rotor 152, 730 to the start angle; re-establishing the pressure of idler rollers 156, 731 on tubing 112; and opening valve 180.

All of the embodiments of the rotary peristaltic pump of the present invention are characterized by the idler roller pressure on the tube bearing the fluid being relieved within the pump while the rotor is returned to its start angle after the dispensing portion of the dispensing cycle is completed. This is achieved by one of retracting the idler rollers of the rotor, moving the stator to a location distant from the rotor, or moving the rotor to a location distant from the stator. The phrase "determined amount of fluid" is used in the present disclosure to describe either or both of an amount of fluid measured during the dispensing of fluid via dispensing needle 130 of FIG. 1, and an amount of fluid determined based on an angle of rotation of rotor 152, 730 of pump 150, 150'.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A peristaltic pump system comprising:

a rotary peristaltic pump comprising a stator and a rotor having a start angle, the rotor driven to rotate about a rotor axis and comprising a plurality of idler rollers arranged radially equidistant about the rotor axis, each roller freely rotating about an own axis parallel to the rotor axis such that upon rotation of the rotor or reciprocation of one of the rotor and the stator varies its position relative to the stator;

a flow valve in fluid communication with an output of the pump;

a fluid path in fluid communication with the valve and comprising flexible tubing disposed between the plurality of rollers and the stator such that when the rotor is rotated at least one of the plurality of rollers is capable of exerting a pressure on the tubing against the stator; and a controller in communication with the pump and with the valve, the controller configured for effecting at the end of a dispensing portion of a dispensing cycle in the following order: closing of the valve, operating of the pump to relieve the pressure of the rollers on the tubing, and rotating of the rotor to the start angle;

wherein the pump further comprises a linear actuator arranged to reciprocate the plurality of rollers between a first location extending beyond the rotor proximate the stator and a second location distant from the stator; and the linear actuator has an actuator rod and is arranged to extend and retract the actuator rod along a rod axis, the actuator rod being fixed to an inner ring of a ball bearing disposed around the rod axis, an outer ring of the ball bearing being freely about actuator rod.

2. The peristaltic pump system of claim 1, wherein the pump further comprises a linear actuator arranged to reciprocate the stator between a first location proximate the rotor and a second location distant from the rotor; and the controller is further configured to relieve the pressure of the rollers on the tubing cause the linear actuator to move the stator from the first location to the second location.

3. The peristaltic pump system of claim 1, wherein the pump further comprises a linear actuator arranged to reciprocate the rotor between a first location proximate the stator and a second location distant from the stator; and the controller is further configured to relieve the pressure of the rollers on the tubing cause the linear actuator to move the rotor from the first location to the second location.

4. The peristaltic pump system of claim 1, wherein the plurality of rollers is retractable into the rotor; and the controller is further configured to relieve the pressure of the plurality of rollers on the tubing by causing the rollers to be retracted.

5. The peristaltic pump system of claim 1, wherein the pump further comprises a linear actuator arranged to reciprocate the plurality of rollers between a first location extending beyond the rotor proximate the stator and a second location distant from the stator; and the controller is further configured to relieve the pressure of the plurality of rollers on the tubing by causing the rollers to be retracted to the second location.

6. The peristaltic pump system of claim 1, wherein the ball bearing includes a bushing comprising a plurality of linkage mounts which are mounted fixedly to the outer ring of ball bearing.

7. The peristaltic pump system of claim 6, wherein the rotor further comprises a plurality of rotor assembly plates, each rotor assembly plate coupled to a corresponding linkage mount and engaging a corresponding roller.

8. The peristalic pump system of claim 1, wherein the controller effects the end of the dispensing portion by the angle of the rotor.

9. The peristalic pump system of claim 1, wherein the controller is further configured to effect the end of the dispensing portion by the amount of fluid dispensed by a dispensing needle of the fluid path.

10. A peristaltic pump system comprising:

a rotary peristaltic pump comprising a stator and a rotor having a start angle, the rotor driven to rotate about a rotor axis and comprising a plurality of idler rollers arranged radially equidistant about the rotor axis, each roller freely rotating about an own axis parallel to the rotor axis such that upon rotation of the rotor or reciprocation of one of the rotor and the stator varies its position relative to the stator;

a flow valve in fluid communication with an output of the pump;

a fluid path in fluid communication with the valve and comprising flexible tubing disposed between the plurality of rollers and the stator such that when the rotor is rotated at least one of the plurality of rollers is capable of exerting a pressure on the tubing against the stator; and a controller in communication with the pump and with the valve, the controller configured for effecting at the end of a dispensing portion of a dispensing cycle in the following order: closing of the valve, operating of the pump to relieve the pressure of the rollers on the tubing, and rotating of the rotor to the start angle;

wherein each idler roller is held in a corresponding roller mount, allowing each roller to rotate freely about a roller axis;

wherein the rotor includes a first and second assembly plate, each assembly plate having a plurality of guide portions, each roller mount being slidably disposed within a pair of corresponding guide portions;

wherein each roller mount has a first and second linkage portions, each of the linkage portions being slidably disposed in a corresponding guide portion;

wherein the pump further comprises a linear actuator arranged to reciprocate the plurality of rollers between a first location extending beyond the rotor proximate the stator and a second location distant from the stator;

wherein the linear actuator has an actuator rod and is arranged to extend and retract the actuator rod along a rod axis; and wherein the actuator rod is fixed to an inner ring of ball bearing disposed around the rod axis, an outer ring of the ball bearing being freely about actuator rod.

11. The peristaltic pump system of claim 10, wherein the ball bearing includes a bushing comprising a plurality of linkage mounts which are mounted fixedly to the outer ring of ball bearing.

12. The peristaltic pump system of claim 11, wherein the bushing is movably disposed relative to the first and second rotor assembly plates.

13. The peristaltic pump system of claim 12, wherein the linear actuator is configured to move the bushing laterally along the rod axis.

14. The peristaltic pump system of claim 13, wherein each guide portion allows the corresponding linkage mount to move relative to the rod axis.

15. The peristaltic pump system of claim 14, wherein each guide portion allows the roller of the corresponding linkage mount to exert pressure on the flexible tubing.

16. The peristaltic pump system of claim 15, wherein at least one linkage portion couples the roller mount with the bushing.

* * * * *